United States Patent [19]

Goglio et al.

[11] 4,314,768

[45] Feb. 9, 1982

[54] SYRUP FEED SYSTEM FOR DRINK DISTRIBUTION APPARATUS OF THE AFTER-MIXING TYPE

[76] Inventors: Luigi Goglio, Via Frua 11; Aldo Bassetti, Via Serbelloni 1, both of Milano, Italy

[21] Appl. No.: 36,735

[22] Filed: May 7, 1979

[30] Foreign Application Priority Data

| | | | |
|---|---|---|---|
| May 5, 1978 | [IT] | Italy | 21739/78[U] |
| May 16, 1978 | [IT] | Italy | 21876/78[U] |
| Mar. 7, 1979 | [IT] | Italy | 20806 A/79 |

[51] Int. Cl.[3] ..... B01F 15/02

[52] U.S. Cl. ..... 366/156; 99/275; 222/105

[58] Field of Search ..... 99/275, 348, 323.3; 222/105, 413; 366/150, 154, 155, 156, 157, 158, 167, 168

[56] References Cited

U.S. PATENT DOCUMENTS

| | | | |
|---|---|---|---|
| 3,081,911 | 3/1963 | Scholle | 222/105 |
| 3,083,877 | 4/1963 | Gash | 222/105 |
| 3,140,861 | 7/1964 | Krup | 366/156 |
| 3,379,116 | 4/1968 | Martin | 99/275 |
| 3,648,904 | 3/1972 | Teige | 222/413 |
| 3,920,223 | 11/1975 | Krueger | 366/156 |
| 4,138,036 | 2/1979 | Bond | 222/105 |
| 4,189,069 | 2/1980 | Stoody | 222/105 |

*Primary Examiner*—Robert W. Jenkins

*Attorney, Agent, or Firm*—Steinberg & Raskin

[57] ABSTRACT

A syrup feed system for drink distribution apparatus of the after-mixing type, comprising a mixing zone, means for dispensing syrup to said zone and means for simultaneously feeding water to said zone with which to dilute the syrup, the system comprising a flexible container containing syrup and provided with a pierceable nozzle, support means for said container, means for receiving at least part of said nozzle, means for piercing said nozzle and means for conveying the syrup from the pierced nozzle to said syrup dispensing means.

33 Claims, 14 Drawing Figures

SYRUP FEED SYSTEM FOR DRINK DISTRIBUTION APPARATUS OF THE AFTER-MIXING TYPE

This invention relates to a new and original syrup feed system for drink distribution apparatus of the after-mixing type. More particularly, the invention relates to a system for feeding the syrup to those means which, in said apparatus, dispense the syrup which is to be mixed with water (gas-treated or otherwise) when the drink is actually required by the user.

Basically, such distribution apparatus of the after-mixing type comprise a mixing zone located upstream of a delivery mouth, means for feeding water to said zone and means for dispensing the syrup to said zone. The water is taken from the water mains, possibly treated with $CO_2$ in a tank, cooled by passage through an environment kept cold by the evaporator of a refrigerating circuit, and delivered to the mixing zone through a closable aperture.

The syrup reaches the means which dispense it to the mixing zone, from a rigid container or tank. In one type of distribution apparatus, this tank consists of a metal drum which is supplied full to the user of the apparatus by the syrup producer, and is then withdrawn for re-filling after its contents have been consumed. When installed, this drum is connected by pipes both to the dispensing means of the distribution apparatus and to a source of pressurised gas, e.g. to the normal carbon dioxide cylinder which is used for gasifying the dilution water. This known method requires not only the provision of connecting pipes and devices for the drum, which represent a certain cost and occupy a space which could otherwise be used, but also requires the connections to be broken and then re-made when an empty drum is replaced by a full drum, and this is not always easy or quick to do. This method also has a series of other drawbacks, as described hereinafter. After a certain operating time, deposits form in the pipes leading from the drum to the dispensing means, and these necessitate periodical disassembly, washing and sterilisation by specialised external personnel. Before filling by the producer, the drum must be carefully cleaned and sterilised.

In another type of distribution apparatus, the syrup container is disposed higher than the dispensing means, which the syrup therefore reaches by gravity. This container can be in the form of an inverted bottle, a rigid disposable plastics container or a rigid vessel provided with a lid, this vessel being topped up as the syrup is consumed. In order to be able to use the bottle as the syrup source, the distrubution apparatus must be provided with means which allow compensating air to enter in order to enable the syrup to flow out. This air which comes into contact with the syrup is a source of pollution, and especially in warm climates or environments can lead to degeneration of the product. The disposable rigid plastics containers do not require the distribution apparatus to be fitted with the compensation means mentioned in relation to the bottles, as it is only necessary to form a simple hole in the container to balance the pressures during syrup consumption. However, the air which enters the container through the hole can lead to the aforesaid drawback. Vessels which can be topped up do not obviate the drawbacks deriving from contact between the syrup and air, as they need to be occasionally cleaned and sterilised, and can be topped up with syrups of an inferior quality, such that they do not ensure that the consumed drink corresponds to the required one, to the detriment of the syrup producer (whose name usually appears on the distribution apparatus), both from the point of view of a loss in sales and from the point of view of the loss of prestige in the eyes of the consumer.

The main object of the present invention is therefore to provide a system based on the use of disposable containers as the syrup feed source for drink distribution apparatus of the after-mixing type, which is free from the aforesaid drawbacks and which guarantees the quality and origin of the product to the consumer.

A further object of the present invention is to provide a system in which the disposable container constituting the syrup source is particularly economical, and is of negligible overall size when emptied so that it does not give rise to storage problems while awaiting transfer to the refuse recovery and/or destruction plant.

A further object of the present invention is to provide a system in which the disposable container can be easily and rapidly installed and removed from the drink distribution apparatus.

A further object of the present invention is to provide a system in which the disposable container which feeds the syrup is opened at a predetermined point during the operation by which it is connected to the drink distribution apparatus.

A further object of the present invention is to provide a system which enables one syrup to be replaced by another, even when the disposable container is partly full, by means of an extremely simple operation without any product losses occurring in practice.

A further object of the present invention is to provide a system in which the parts in contact with the syrup are easily removed and cleaned.

An interesting object of the present invention is to provide a system which can be easily utilised in drink distribution apparatus already in use, by only slight modifications thereto.

These and further objects which will be more apparent from the detailed description given hereinafter are attained by a syrup feed system for drink distribution apparatus of the after-mixing type, comprising a mixing zone, means for dispensing syrup to said zone and means for simultaneously feeding water to said zone with which to dilute the syrup, the system comprising a flexible bag containing syrup and provided with a pierceable nozzle, support means for said bag, means for receiving at least part of said nozzle, means for piercing said nozzle and means for conveying the syrup from the pierced nozzle to said syrup dispensing means.

The invention will be more appararent from the detailed description given hereinafter by way of non-limiting example of a preferred embodiment thereof, illustrated in the accompanying drawings in which.

Figures 1, 2:
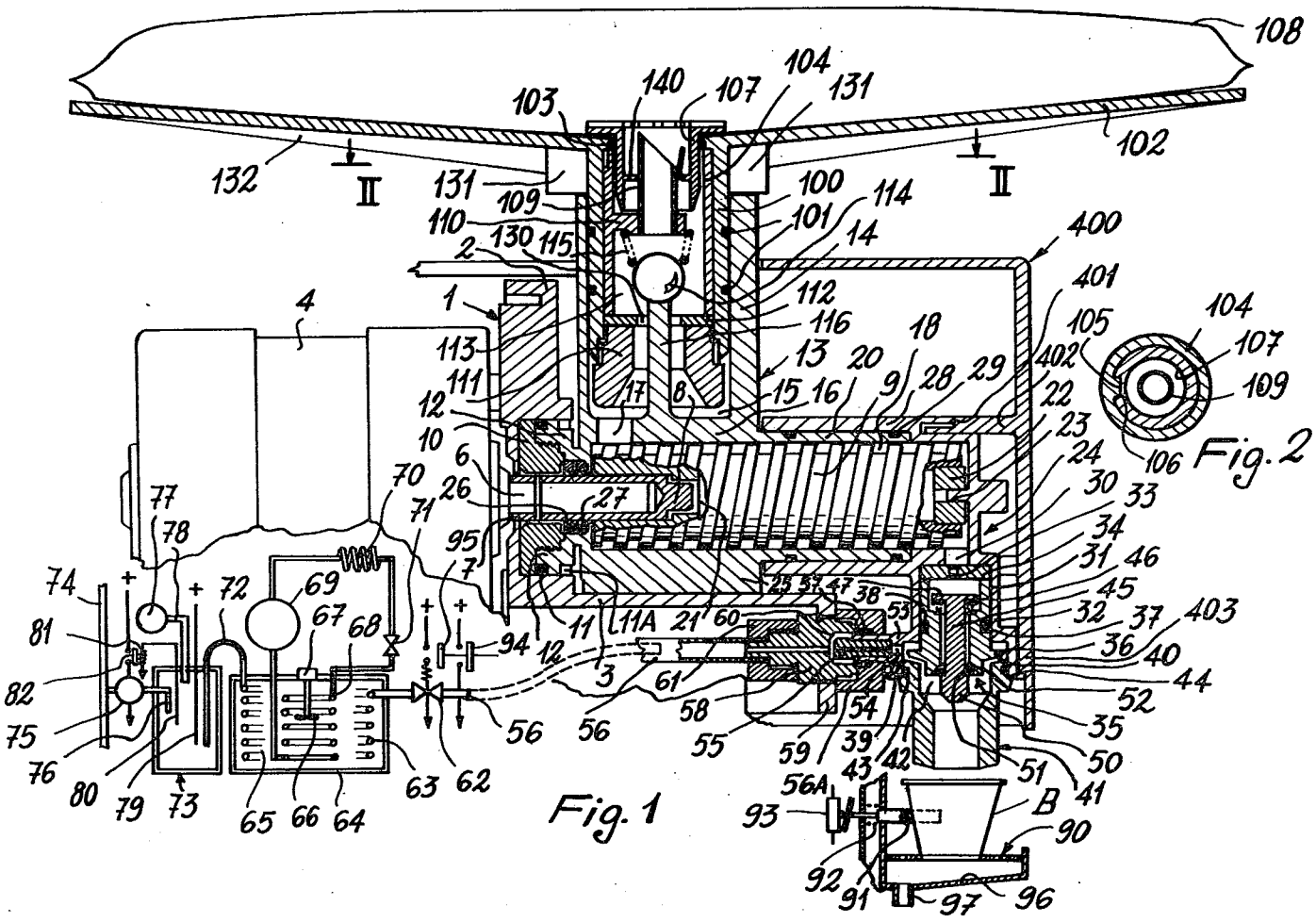
FIG. 1 is a view partly in longitudinal vertical section and partly diagrammatic, of a drink distribution apparatus of the after-mixing type.
FIG. 2 is a partial section on the line II—II of FIG. 1.

With reference to FIGS. 1 and 2; the drink distribution apparatus of the after-mixing type shown therein comprises a support structure 1 consisting of a vertical side wall 2 and a horizontal shelf 3. An electric motor 4 is fixed to the side wall 2 by screw means, not shown. The shaft 6 of the motor 4 passes through an aperture in the side wall 2, and has mounted and dowelled on to it a drive stem 7 with an end or head 8 having a cross-section which is other than circular, e.g. square. The purpose of this stem is to rotate a worm 9 which will be described hereinafter.

The shaft 6 and stem 7 pass through a discoidal member 10 screwed to the rear circular flange 12 of a piece indicated overall by 13. On screwing the discoidal member 10 into the flange 12, an annular seat is produced in the circumference, into which a resilient centering ring 11 is mounted, to facilitate the forced mounting of the piece 13 into a suitable circular seat 11A provided in the side wall 2 of the support structure 1. The piece 13 is moulded from a plastic material, e.g. polycarbonate, and comprises a portion 14 directed upwards and defining an upwardly open cylindrical chamber 15. The base 16 of said chamber comprises an eccentric bore 17 which connects said chamber to a second cylindrical chamber 18 with its axis perpendicular to the preceding one, and which extends in the form of an appendix 20 to the piece 13. In the second chamber 18 is disposed the worm 9, the maximum diameter of which is less than the diameter of the chamber so that an interspace is formed between the crests of the worm threads and the chamber surface. In the example illustrated, the worm is of the single-start type, and its thread is of rectangular cross-section. The worm comprises an axial bore 21 in the form of several portions of different cross-section. The first of these portions on the left houses the cylindrical part of the stem 7, the second portion houses the drive head 8, the cross-section of which corresponds to the cross-section of the second portion to enable motion to be transmitted to the worm 9, and in the third portion there is forcibly mounted a boss 22, into the central bore of which there extends a cylindrical prong 23 which acts as a support pivot and is integral with a piece 24 which will be described hereinafter, and which is also constructed of a moulded plastics material, for example polycarbonate.

The piece 13 lowerly comprises a flat rib 25 by which it rests on the shelf 3 of the support structure of the distribution apparatus. The rear flange 12 and discoidal member 10 define inside the piece 13 an annular seat 26 in which two seal rings 27 are disposed.

The piece 24 comprises an appendix 28 with a circular bore which, in its portion of smaller cross-section, defines the right hand end of the chamber 18 in which the worm 9 is disposed. In its portion of greater cross-section it received the tubular appendix 20 of the piece 13. Two spaced-apart seal rings 29 housed in grooves in the appendix 20 and partly projecting therefrom, provide both a seal and a forced coupling between the two appendices 20 and 28.

In proximity to the right hand end of the chamber 18, a bore 30 is provided in the piece 24 to connect said chamber to a cylindrical cavity 31 formed in a second appendix 32 of the piece 24. In the example shown, the axis of this cavity is perpendicular to the axis of the chamber 18.

On the base of the cavity 31 there is a disc 34 comprising a restriction bore 33. This disc is kept in situ by the edge of a plastics member 35 which comprises a cylindrical portion, a flange 36 with its lower face substantially conical, and a final cylindrical portion of smaller cross-section than the first portion. The member 35 is forcibly inserted into the cavity 31, and for this purpose it houses in a peripheral groove 37 a resilient seal ring 38 having an original diameter which interferes with the cavity 31. When the member 35 is mounted in situ, its flange 36 remains peripherally and axially spaced apart from the walls of a portion 39 which has a greater diameter than the cavity 31. The flange 36 also remains spaced apart from the conical end wall 40 of a mouthpiece 41 through which the drink is delivered. Said mouthpiece, together with the member 35, defines a mixing zone 42 in which the syrup is mixed with the water.

The mouthpiece 41 is force-fitted into the lower end of the portion 39 by virtue of the interference of the resilient ring 43. The extent of penetration of the mouthpiece 41 is limited by a radially projecting rim 44 thereof resting against the lower end of the appendix 32.

A closure member 45 is slidably mounted (with substantial radial slack) in the axial bore of the member 35, and is loaded by a compression spring 46 situated between its head 47 and a step inside the member 35.

At its lower end, the closure member 45 comprises a cylindrical expansion 50 having a diameter equal to or less than the diameter of the bore in the member 35, along which the closure member can move. This enables the closure member to be fitted into the member 35. A resilient seal ring 51 is mounted in a circular seat provided in the expansion 50. This ring, under the thrust of the spring 46, makes a seal against the terminal conical portion 52 of the axial bore in the member 35.

Approximately at the level of the flange 36, the appendix 32 comprises a radial cylindrical extension 53 which communicates with the cavity 31 by way of a bore 54. In this extension 53 there is a restriction piece 55, the purpose of which is to reduce the pressure of the mixing water which arrives from the tube 56.

The extension 53 and restriction piece 55 extend inside a ring nut 56A containing a pair of resilient seal rings 57 which adhere against the extension 53. The ring nut is screwed on to a connector 58 which extends partly through a bore in a flange 59 of the shelf 3. The connector 58 comprises a chamber 60 into which the restriction piece 55 penetrates. The flexible tube 56 is mounted over the reduced end of the connector, and is locked by a ring nut 61 screwed on to the connector.

The tube 56 terminates at the outlet of a solenoid valve 62, the inlet of which is connected to a coil 63 disposed in a thermally insulated closed vessel 64. A mass of water 65 is disposed in the vessel, and is kept stirred by a stirrer blade 66 driven by an electric motor 67. This mass 65 and consequently the water flowing through the coil 63 are cooled by a second coil 68 disposed in the vessel and forming the evaporator of a normal temperature-controlled refrigeration circuit comprising a motor-driven compressor 69, a condensing bank 70 and expansion means, shown here as a valve 71.

The water cooling coil 63 is connected to a pipe 72 which dips into the water contained in a vessel 73 for gas-treating the water. The water to be gas-treated is withdrawn from the water mains 74 by an electrically driven pump 75 which feeds it to a pipe 76 provided with a plurality of transverse bores. This pipe terminates below the level of the water contained in the vessel 73. The water leaving the bores is enriched with $CO_2$ supplied from a cylinder 77 connected to the vessel 73 through a pressure reducing valve (not shown) and the conduit 78, which opens into the vessel above the water contained therein. Two electrodes at different levels 79, 80 penetrate into the vessel. When the water touches the two electrodes, the circuit from the positive pole to earth, in which the relay 81 is connected, is closed. The consequent energisation of the relay causes the contact 82 to open, so stopping the pump 75. When the level reduces as water is fed from the vessel 73, the circuit opens, the relay becomes de-energised and the contact 82 closes, to start the pump 75 which feeds water to the vessel.

One example of how the drink can be delivered into a tumbler B from the nozzle 41 is shown in FIG. 1. The tumbler is rested on a perforated plate 90 in the apparatus and is thrust by hand against a fork 91 which moves against a spring 92. When the fork 91 has withdrawn as far as is possible, it activates a micro-switch 93, the two contacts 94,95 of which close to open the solenoid valve 62 and start the motor 4. By this means, water and syrup arrive (as will be apparent hereinafter) into the mixing zone 42, and the drink emerges from the mouthpiece 41. When the user considers that the tumbler B has been filled with a sufficient quantity of drink, he withdraws the tumbler, so stopping the outflow of the drink. Any liquid dripping from the nozzle passes through the perforated plate 90, is collected on the bottom 96 and is discharged through the base mouth 97. To prevent deposit formation, the contact can be made to act not directly on the solenoid valve 62, but indirectly by way of a delay opening relay. This allows a certain quantity of wash water to be delivered after the tumbler B has been withdrawn.

A hollow member 100 having a shape corresponding to the cylindrical chamber 15 of the apparatus is disposed therein, and is provided externally with seal rings 101.

The hollow member 100 is rigid with a tray 102 from which it projects downwards from the lowest part of the tray.

The following are mounted from the top upwards in the hollow member 100 in succession, as shown in FIG. 1: a resilient seal ring 103 abutting against an annular shoulder, a guide bush 104 possibly provided with a projection 105 for engaging in a suitable groove 106, a nozzle 107 fixed to a bag 108 containing the syrup, a perforating device of the flute neck type indicated by 109 and rigid with a perforated flange or shelf 110 in the bush 104, a washer 112 and a bush 111 screwed into the lower end of the hollow member 100 to retain the aforesaid members in position in a sealed manner. In the space 113 formed between the flange 110 of the perforator and the washer 112 there is a ball 114 which under the action of a spring 115 closes the bore 130 in the washer 112.

When the member 100 is inserted into the chamber 15 as shown in FIG. 1, a finger 116 disposed centrally in the chamber penetrates through the bore 130 into the space 113 to raise the ball 114 and open the aperture 130.

The tray 102 comprises stop lugs 131 and strengthening ribs 132.

On the tray support 102 is laid the flexible bag 108 containing syrup and provided with the exit nozzle 107 for insertion into the initial upper part of the hollow member 100, this initial part consisting of the seal ring 103 and bush 104 and forming an insertion connector for the nozzle 107. On inserting the nozzle 107, the flute neck 109 perforates the transverse wall 140 of the nozzle which was previously closed, and the outer wall of the nozzle makes a seal against the seal ring 103. The syrup contained in the bag 108 can therefore flow out through the hollow flute neck and the passage not occupied by the shelf 110, to reach the space 113 from which it can flow through the bore 130 when the ball 114 is raised. The syrup then flows through the bore 17 into the worm chamber 9.

The bush 104 mounted in the hollow member 100 can comprise a projection 105 (see FIG. 2) with which there corresponds an analogous groove 106 in the outer wall of the nozzle 107. By this means, only nozzles provided with a groove corresponding in its shape and arrangement to the projection provided on the bush 104 can be inserted into the connector, i.e. into the bush 104.

Different types of such reference means can obviously be provided, with different shapes and in different positions, and it is therefore possible to create a personalisation system which makes it impossible to fit on to any particular distribution apparatus any bags not especially designed for this particular apparatus. This represents a guarantee for the syrup producer and also for the consumer, who is therefore ensured of the genuineness and authenticity of the drink which is served to him.

It should also be noted that the shape of the tray support 102 is chosen in accordance with the type of bag used, so as to ensure that the bag always lies in a position which enables the syrup to flow towards the outlet until the bag is totally empty, as the outlet is at the lowest point of the tray.

The unit constituted by the tray 102 and hollow member 100 can be removed from the apparatus chamber 15 even with the bag fitted, i.e. with its nozzle inserted into the connector, without danger of the syrup flowing from the bore 130. In this respect, as soon as the hollow member 100 is raised from the chamber 50, the finger 116 ceases to act on the ball 114 which under the action of the spring 115, automatically closes the bore 130. This aspect is important from the point of view of periodically cleaning the distribution apparatus and its delivery device.

With regard to the construction of the described apparatus, the stresses which arise during its operation are opposed by a cover 400. This cover is removably fixed in any known manner to the apparatus structure 1. A step 401 in its wall 402 acts against an opposing step in the piece 24, and its front side 403 acts against the appendix 32.

The advantages obtained are apparent from the preceding description.

As an alternative or in addition to the identification or coding system of FIG. 2, the nozzle can have different cross-sections according to the origin of the bag or envelope, and the relative connector in the apparatus will then be given a conjugate cross-section.

Figure 3:
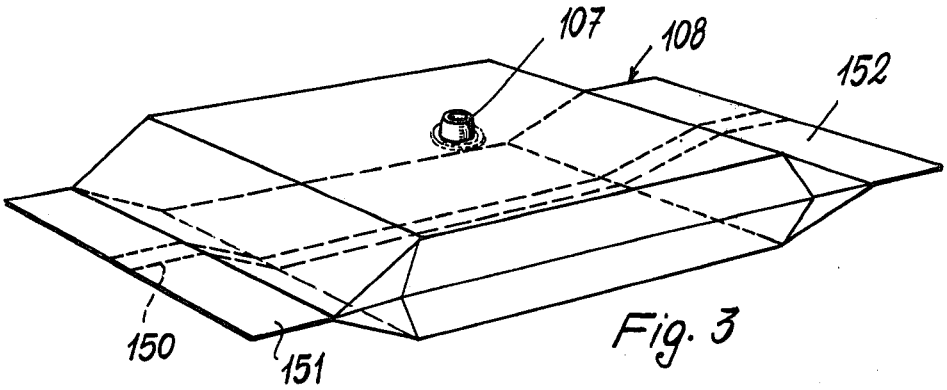
FIG. 3 is a perspective view of a thermoweldable bag with side bellows, which is provided with a pierceable nozzle and suitable for use in the apparatus of FIGS. 1 and 2.
Figure 4:
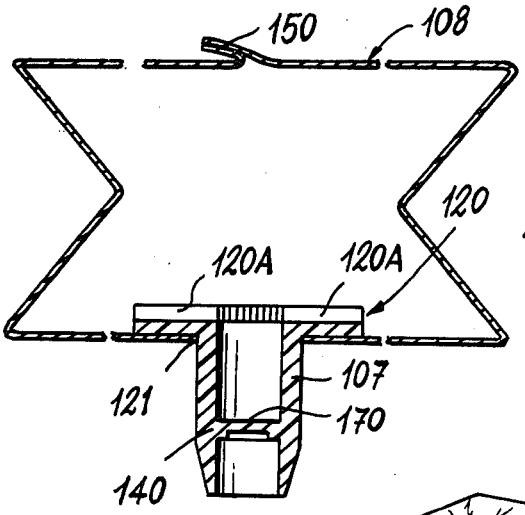
FIG. 4 is a partial cross-section through the bag of FIG. 3 on a diametrical plane through its nozzle.
Figure 5:
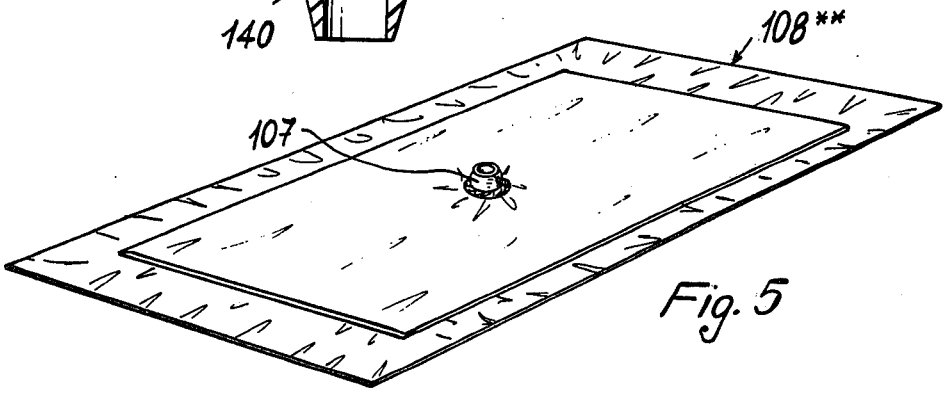
FIG. 5 is a perspective view of a thermoweldable bag in the form of an envelope, which is provided with a pierceable nozzle and is suitable for use in the apparatus of FIGS. 1 and 2.
Figure 4A:
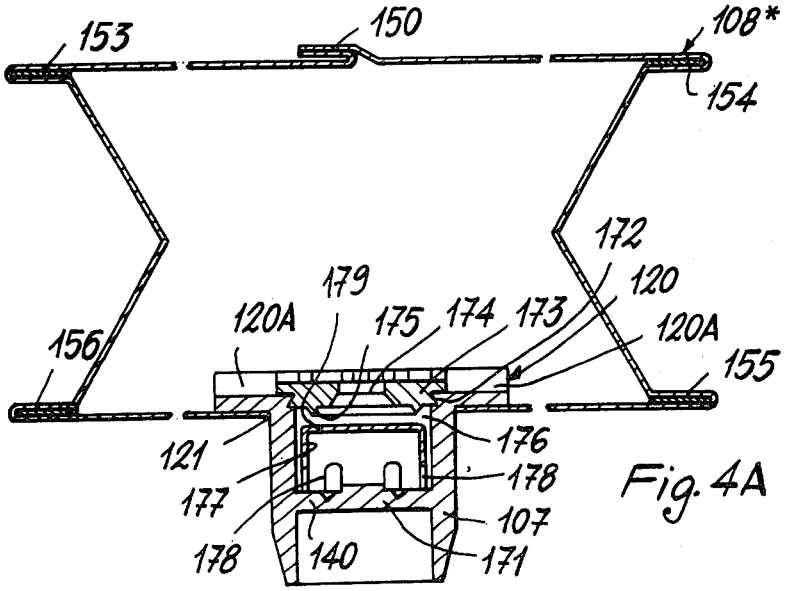
FIG. 4A is a cross-section through a different type of bag provided with a pierceable nozzle incorporating a non-return valve to prevent any unwarranged filling of the empty bag.

The bag 108 containing the syrup can be of the side bellows type as shown in FIGS. 3 and 4, or with side bellows thermowelded along their longitudinal edges as shown in FIG. 4A in which it is indicated by 108*, or in the form of an envelope as shown in FIG. 5 in which it is indicated by 108**.

The sheet material from which the bag is formed preferably consists of several layers, for example three, joined together by adhesives, the internal layer being thermoweldable, for example of polyethylene or polypropylene. In the case of three-layer material, the remaining two layers can be polyester and aluminium. The thicknesses of the layers can lie between 20 and 80$\mu$. These materials are known and will not be discussed further.

Each bag is provided approximately in the centre of one of its faces with a hole 121. The nozzle 107 emerges from this hole and is provided with a flange 120 which is fixed to the inner layer of the material by thermowelding along the contour of the hole. The nozzle is moulded from a plastics material which can be thermowelded to the inner layer by means of a heated tool. Thus if the material of the inner layer is polyethylene, the nozzle will be of the same material. The same applies in the case of polypropylene. The other layers must have a melting or softening point greater than those of the inner layer.

The nozzle 107 is closed by an integral transverse diaphragm 140 which can be located at the outer end of the nozzle, but which is preferably situated at a certain distance from this end as shown in FIGS. 4, 4A. This end is advantageously conical externally. The closure diaphragm comprises a central weakened zone 170, 171 to enable it to be pierced by the flute neck 109. In addition, on its inner face the flange 120 comprises a series of radial grooves 120A, the purpose of which is to enable the syrup to reach the nozzle 107 even when that part of the bag opposite the part which contains the nozzle is adhering against the flange 120.

The bag 108 comprising the side bellows (FIGS. 3, 4) comprises in this example a longitudinal thermoweld 150 which joins together the end edges of the sheet or strip of material forming the bag. A transverse end thermoweld 151 is also made, and after the bag is filled a transverse parallel weld 152 is made to close the filling mouth for the product.

As shown in FIG. 4A, the bag, which is indicated here by 108*, comprises the longitudinal welds 150 and the transverse welds, and in addition for strengthening reasons can also comprise longitudinal welds 153,154,155,156 at the longitudinal edges.

The envelope-type bag 108 of FIG. 5** comprises thermowelds along all its four perimetral edges when it has been filled. These thermowelds are indicated by light-dashed lines in this Figure. It is apparent that only three welds would be sufficient if the bag is formed from a folded sheet, instead of two superposed sheets.

The thermowelds can be made by heated tools or jaws well known in the thermowelded bag field.

As can be seen in FIG. 4A, the nozzle can incorporate a non-return valve, the purpose of which is to prevent the unauthorised introduction of syrup into the bag after its original contents have been consumed. The nozzle in question comprises a dovetailed annular groove 172 at the level of the flange 120 in its inner side. A moulded plastics disc 173 is snap-inserted into this groove. The disc is perforated centrally at 174 and comprises an annular projection 175 on its inner face. A cup 177 comprising a series of passages 178 along its edge is disposed freely in the chamber 176 defined by the cylindrical wall of the nozzle, the transverse wall 140 and the disc 173. When the bag 108* is fitted to the distributor (see FIG. 1) and its nozzle has been pierced by the flute neck 109, the syrup can flow freely from the nozzle through the bore 174, the interspace between the cup 177 and the walls of the chamber 176, and the passages 178. When the empty bag is removed from the distributor and overturned so that its nozzle 107 points upwards, the base wall 179 of the cup 177 forms a seal against the projection 175 to prevent any unauthorised introduction of syrup.

Figure 6:
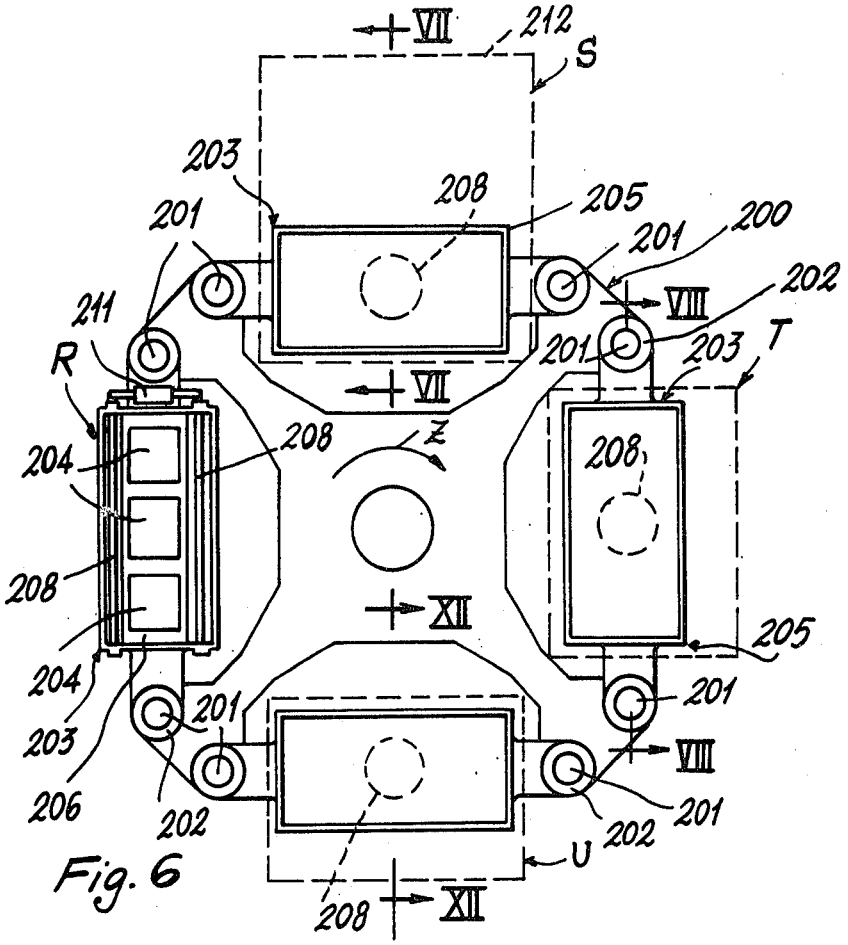
FIG. 6 is a diagrammatic plan view of the intermittently rotating turntable machine on which the bag is automatically filled and sealed.

The containers can be filled with syrup in any suitable manner, including manually, this latter being done by placing the container with its mouth open under a tap from which the syrup flows. When the container has been filled, the mouth is sealed by thermowelding. The container can be filled and sealed automatically by a suitable machine which is described hereinafter and shown diagrammatically in FIG. 6 onwards.

The machine comprises a crosspiece 200 which is rotated stepwise by means, for example, of a maltese cross-mechanism, not shown. Two upwardly pointing pins 201 are fixed at the ends of each of the arms of the crosspiece. Lugs 202 are mounted on pairs of pins, these lugs projecting laterally from receptacles 203, each of which can be loaded for example with three bags 108, one in each seat 204 provided in the receptacle. Each receptacle can slide vertically along its respective pair of pins 201 under the action of stationary pneumatic pistons 208 disposed at three of the four working stations R,S,T,U. In the first of these stations, indicated by R, the empty bags are inserted manually, and the full bags are removed manually. The direction of rotation of the crosspiece 200 is indicated by Z, and in the next station S the mouth of the bag 108 is opened and the bag filled with syrup. In the third station T, the mouth of the bag is flattened, and in the fourth station U, the mouth is thermowelded. Alternatively, flattening and thermowelding can take place in station T, and the removal of the closed bags in station U. However, However, in this case the lifting piston 208 would not be provided in this latter station.

The receptacles 203 are in the form of an outer upperly open housing 205, and an inner upperly open housing 206 which defines the compartment 204 receiving the bags and is of such a form as to contain the deformation of the bag 108 and to maintain it in its correct position. A longitudinal slot 207 is provided in each compartment 204 in one of the walls of the inner housing, to guide the bag nozzle 107.

Two horizontal shafts 208A are rotatably supported in each receptacle 203 and each carries a series of arms 209 which are interconnected at their ends by a strip 209A. The purpose of the strips 209A is to bring together the two non-bellows walls of the bag 108 above the maximum level K reached by the syrup in the bag. These shafts 208A emerge from the opposite ends of the receptacle and radial appendices 210 are fixed externally on them, between these appendices there being hinged a pneumatic jack 211 which controls the rotation of the arms 209 and consequently the rotation of the strips 209A.

When the receptacle with its empty bags reaches station S (see FIG. 7), the relative lifting piston 208 is operated to lift the receptacle 203 along the pins 201. After a certain vertical distance, two sets of suckers 210A are pushed by pneumatic pistons 211A against the opposing walls of the bag in proximity to its mouth. The suckers 210A are connected to a suction source (not shown) and then pulled apart by reversing the direction of movement of the pneumatic pistons 211A, so as to sufficiently open the bag mouth. The pneumatic pistons 211A are hinged by their cylinder to a frame 212 which can slide along vertical columns 213, and which when the suckers engage with the bag rests on collars 219 on the columns 213. The rods 214 of the pneumatic pistons are hinged to an arm of a parallelogram H, this arm being hinged at one end to the frame 212 and at its other end to a block 214A which carries a group of suckers. The arm on which the rod 214 acts extends upwards and is connected to a rod 216 which transmits movement to an arm of a second parallelogram H1, disposed symmetrically and supported by the frame 212, and with which a further group of suckers, also carried by a block 214A, is associated.

When the suckers 210A engage with the bag 108, a lateral extension 217 connected to the rod 208B of the piston 208 moves the frame 212 by means of a sliding rod 218, so that the frame moves jointly with the receptacle 203, withdrawing from the stop collar 219. The lifting movement continues until the bag mouth surrounds the outlet 220 of a stationary conduit 221 used for conveying the syrup (see position shown in FIG. 7). A disc valve 223 seals against the inner conical surface 222 of the opening 220, and its control rod 224 passes out through the elbow of the conduit 221 to terminate in an operating member 225. This latter lifts the disc 223 from its seat 222, and a metering pump 226 then feeds the set quantity of syrup through the delivery valve 227. The metering pump shown is of the piston type, operated by a crank 228, and received the syrup from a vessel 229 through the suction valve 230 when the piston 231 makes its suction stroke. When filling is terminated, the valve 223 closes and the piston 208 is lowered, vacuum then being removed from the suckers 108A. The frame 212 stops against the collar 219 and the receptacle 203 again rests on the relative arms of the crosspiece 200. Except for the lifting operation, which is controlled by a contact when the receptacle 203 reaches station S, the various operating stages can be controlled by a series of linear cams 232 fixed to the extension 217 and operating on a series of microswitches 233, only one of which is shown on the drawing for reasons of simplicity.

Figure 11:
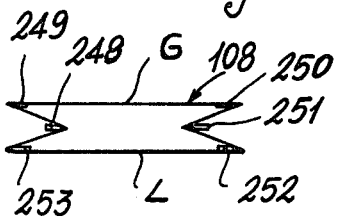

The crosspiece 200 then makes a further forward step and moves the said receptacle 203 into station T where a further lifting piston 208 is provided together with an operating head 240, this lying above the receptacle and being supported for example by columns 241 (see FIGS. 8, 9, 10, 11), and which by means of the members described hereinafter forces the bag walls together at the bag mouth, as shown in FIG. 11.

Two superposed slides 242, 243 are guided in the head 240 and are driven in opposite directions (arrows x.y) by a double acting pneumatic jack 244. For this purpose the cylinder of the jack 244 is connected to a rod 245 rigid with the upper slide 242, while the rod 246 is connected via another rod 247 to the lower slide 243.

Figure 8:
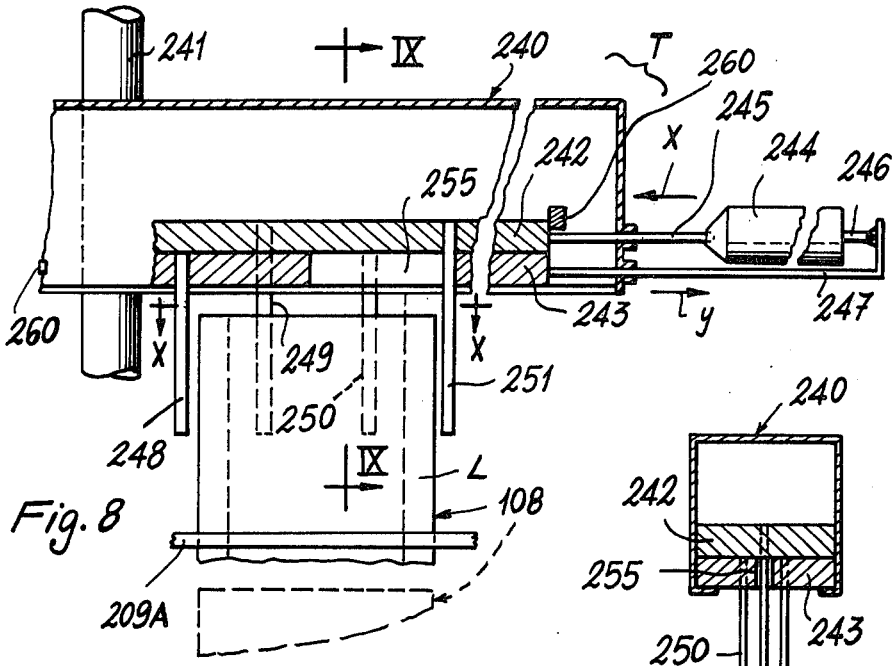
FIG. 8 is a diagrammatic vertical section on the line VIII—VIII of FIG. 6, through the station for flattening the mouth of the bag after its filling with syrup.
Figure 9:
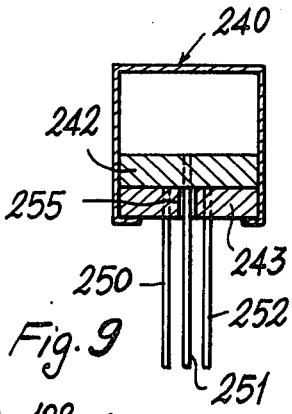
FIG. 9 is a partial section, with some parts omitted, on the line IX—IX of FIG. 8.
Figure 10:
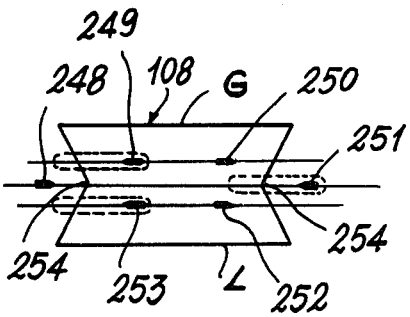
FIGS. 10, 11 are diagrammatic views from above showing the position of the blades or fingers for flattening the bag mouth before and after the operation of said blades.

To force together the walls of the three side bellows bags 108 contained in the repectacle 203, a set of blades or thin fingers 248–254 fixed to the slides 242, 243 and pointing downwards is used for each bag. FIG. 8 shows only one of the three sets of fingers, as to remaining two are identical both in construction and assembly.

The fingers 249,251 and 253 are fixed to the upper slide 242, whereas the remaining three (248,250,252) are fixed to the lower slide 243. The fingers 248,241 lie in the same vertical plane in which the edges or folds 254 of the side bellows of the bag 108 substantially lie. The pairs of fingers 249,250 and 252, 253 lie in two vertical planes which are parallel to each other and to the plane of the fingers 248, 251. The distance between the vertical planes containing the pairs 249,250 and 252, 253 is equal to the distance-apart to which the major walls G and L of the bag 108 are to be moved.

In their non-working position (see FIGS. 8, 10), the fingers are disposed such that those indicated by 249,250,252 and 253 are within the mouth of the bag 108 when this latter is raised, and outside the fingers 248, 251.

To enable the fingers 249,241,253 fixed to the upper slide 242 to move, the lower slide 243 is provided with suitable longitudinal slots such as that indicated by 255.

When the bags 108 (which begin their upward movement from the position indicated by dashed lines) reach their limiting position of FIG. 8 following the raising of the receptacle 203, the jack 244 is operated so that it extends and moves the slides 242, 243 in the directions of the arrows x, y respectively. As a result of this (see FIG. 11), the fingers 248, 251 move towards each other, whereas the pairs of fingers 249, 253 and 250, 252 move away from each other, so that the bag mouth becomes exactly shaped in spite of the presence of the syrup, and the non-bellows walls G,L are brought very close together.

The jacks 211 (see also FIGS. 6, 7) are operated, and on extending they apply the bars or strips 209A against the bag walls G,L which in this manner are brought practically together. The strips 209A (see FIGS. 7, 8) are applied against these walls above the syrup lievel K, but at a certain distance from the lower end of the fingers 248–253. The jacks 211 remain activated even during the thermowelding of the bag mouth, which is carried out in the next station U.

After this, the bags are lowered together with the receptacle 203, and after leaving the bag the fingers 248–253 return to their initial position by operating the jacks 244 in the opposite direction.

Stops such as those indicated by 260 limit the return stroke of the slides 242,243, whereas the sides of the head 240 limit its working stroke.

Figure 7:
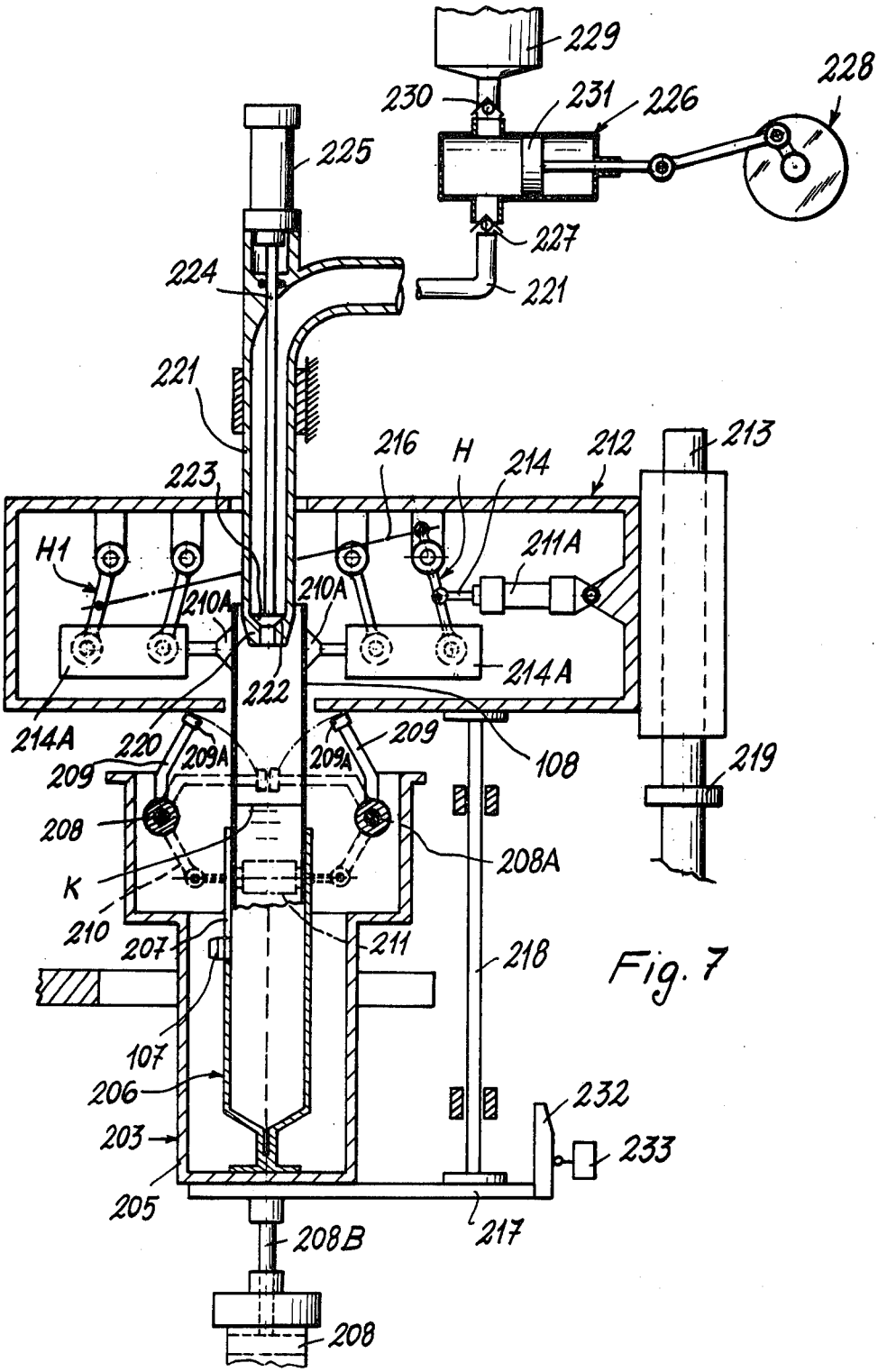
FIG. 7 is a diagrammatic vertical section through the filling station, on the line VII—VII of FIG. 6.

Control can be determined by a cam arrangement analogous to that indicated by 232,233 in FIG. 7.

If using the envelopes 108 of FIG. 5, the head 240 will comprise a single pair of coplanar fingers for each envelope, mobile in opposite directions in the envelope mouth. The two fingers will be carried respectively by the slides 242,243**.

Figure 12:
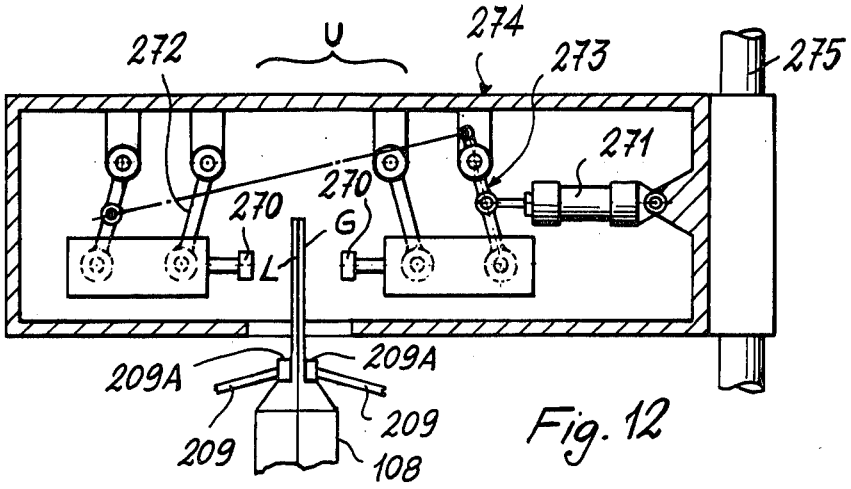
FIG. 12 is a partial diagrammatic section on the line XII—XII of FIG. 6.

The crosspiece then rotates through one step and brings the receptacle 203 into the station U (see FIG. 12) where the corresponding lifting piston 208 lifts the receptacle 203 and consequently the bags 108, which are carried by their mouth between thermowelding jaws 270 heated electrically in known manner, and which extend over the entire width of the bag in pairs. The jaw 270 is closed and opened by an interconnected parallelogram device 272, 273 operated by pneumatic jacks 271 and similar to that used for controlling the suckers 210A as shown in FIG. 7. The device in question is contained in a headpiece 274 supported by columns 275.

When the receptacle 203 is again lowered, the strips 209A are withdrawn from the bags, and the receptacle arrives in the loading station R by rotating the crosspiece 202. The operator removes the full bags and inserts the empty bags.

Alternatively, the mouth can be welded in station T, using the same method as described, after bringing the sides G and L of the bag mouth together. In this case, the bags will be extracted from station U, for example using automatic grips.

Figure 13:
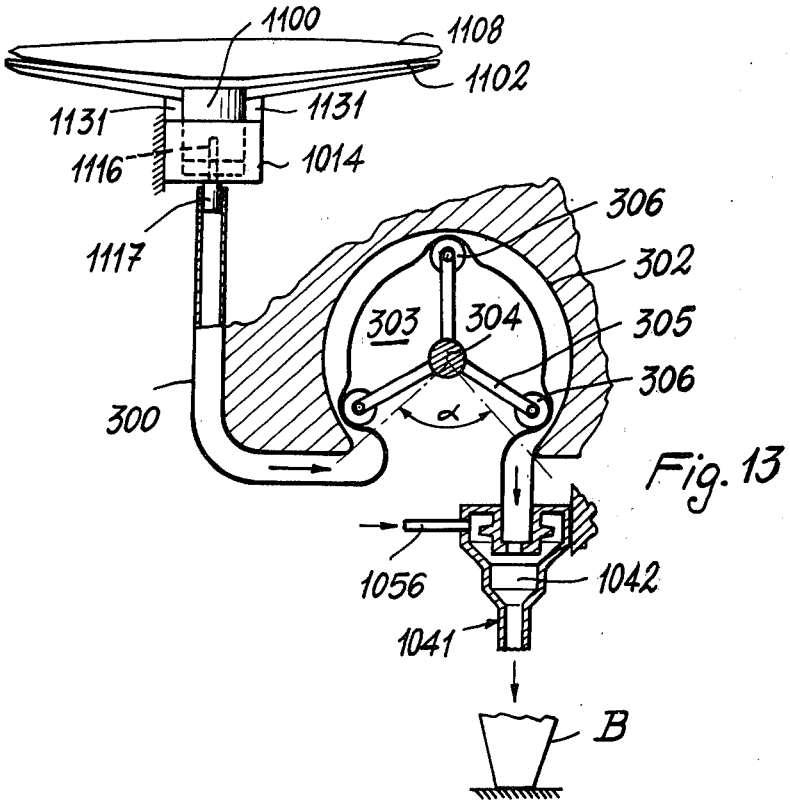
FIG. 13 is a diagrammatic view of a different type of drink distributor with which the system according to the invention can be used.

FIG. 13 shows diagrammatically a distributor of the after-mixing type using a peristaltic pump. In this figure, parts equal or corresponding to those of FIG. 1 carry the same reference numerals but with the addition of 1000. The bag 1108 containing the syrup is supported by the tray 1102. The tray is provided with the hollow member 1100 which incorporates all the elements of the corresponding member 100 of FIG. 1. The hollow member 1000 is mounted in the cavity of the member 1014, from the base of which there projects the finger 1116 for opening the non-return valve. The member 1014 is provided with a base outlet 1017 over which is mounted the end of a flexible tube 300. Before being connected to the mixing zone 1042 to which the water flows through the conduit 1056, this tube extends along the surface 302 of a cylindrical chamber 303 open over a certain angle $\alpha$. In this chamber there is a concentric shaft 304 driven by a geared motor, not shown, when the drink is to be delivered into the tumbler B. The shaft comprises three radial equidistant arms 305. The end of each arm supports an idle roller 306 which squeezes the tube 300 at continuously different points, so compelling the syrup to move along the tube towards the zone 1042 where it is mixed with the water.

What we claim is:

1. A syrup feed system for drink distribution apparatus of the after-mixing type, comprising a mixing zone, means for dispensing syrup to said zone and means for simultaneously feeding water to said zone with which to dilute the syrup, the system comprising a flexible container containing syrup and provided with apierceable nozzle, support means for said container, means for receiving at least part of said nozzle, means for piercing said nozzle and means for conveying the syrup from the pierced nozzle to said syrup dispensing means.

2. A system as claimed in claim 1, wherein the flexible container is of thermoweldable material, and is provided with an aperture through which there projects the nozzle, which is fixed by thermowelding on the inner side of the contour of said aperture.

3. A system as claimed in claim 2, wherein the nozzle comprises a fixing flange provided with radial channels.

4. A system as claimed in claim 2, wherein the flexible container is a bag with side bellows, comprising transverse welds.

5. A system as claimed in claim 4, wherein the bag with side bellows comprises longitudinal welds along its edges.

6. A system as claimed in claim 2, wherein the flexible container is an envelope.

7. A system as claimed in claim 1, wherein the nozzle is closed by a transverse wall in one piece therewith, and provided with a zone of lesser resistance.

8. A system as claimed in claim 7, wherein the transverse wall is spaced apart from the end of the nozzle.

9. A system as claimed in claim 1, wherein the nozzle incorporate a non-return valve.

10. A system as claimed in claim 1, wherein the outer end of the nozzle is of decreasing cross-section.

11. A system as claimed in claim 1, wherein the support means for the flexible container are in the form of a tray, with the support surface for the container inclined to facilitate the emptying thereof.

12. A system as claimed in claim 1, wherein the means for receiving at least part of the nozzle are connected to the container support means.

13. A system as claimed in claim 12, wherein the means for piercing the nozzle are associated with the means for receiving it.

14. A system as claimed in claim 13, wherein the means for piercing the nozzle are constituted by a flute neck tube portion.

15. A system as claimed in claim 14, wherein the flute neck tube portion is disposed in the means for receiving the nozzle, which are of tubular shape and are provided with an inner transverse support from which the tube portion extends upwards, said support extending over only part of the cross-section of said means.

16. A system as claimed in claim 15, wherein the means for receiving the nozzle comprise a hollow cylindrical appendix rigid with the bag support means, a bush provided with an inner transverse support from which the tubular portion extends upwards, a ring nut screwed on to said cylindrical appendix, and a non-return valve.

17. A system as claimed in claim 16, wherein the syrup conveying means comprise a chamber connected to the syrup dispensing means, and to which the means for receiving the nozzle are removably connected.

18. A system as claimed in claim 17, wherein the means for receiving the nozzle are associated with the container support means and with the means for piercing it, and further comprise a non-return valve and are removably insertable into the chamber of the syrup conveying means, there projecting into said chamber an appendix for opening the valve.

19. A system as claimed in claim 1, wherein the syrup dispensing means comprise a worm and means for operating said worm.

20. A system as claimed in claim 19, wherein the worm rotates in a first chamber of slightly greater diameter which has an outlet comprising unidirectional valve means which partly border a second chamber into which the water feed means open.

21. A system as claimed in claim 20, wherein said second chamber is disposed upstream of the outlet of the valve means.

22. A system as claimed in claim 21, wherein the valve means comprise a flange projecting into said second chamber.

23. A system as claimed in claim 1, wherein the mixing zone is situated in a drink delivery mouthpiece.

24. A system as claimed in claim 1, wherein the nozzle has a cross-section conjugate with that of the means for receiving it.

25. A system as claimed in claim 1, wherein the flexible container provided with the nozzle is filled with the syrup and sealed in an automatic machine in which the container is fed intermittently under a series of operating stations disposed in succession one to the other.

26. A system as claimed in claim 25, wherein the automatic machine comprises an intermittently rotating table supporting a series of raisable receptacles into which the flexible containers provided with their nozzle are placed.

27. A system as claimed in claim 26, wherein the receptacles are raised by stationary pressurised fluid jacks.

28. A system as claimed in claim 26, wherein the receptacles comprise a series of separate compartments for housing the flexible containers.

29. A system as claimed in claim 26, wherein the raisable receptacles comprise means for shutting the mouth of the flexible containers.

30. A system as claimed in claim 25, wherein a first operating station comprises sucker means for widening the mouth of the flexible containers, and means for metering and feeding the syrup to the containers.

31. A system as claimed in claim 25, wherein a second operating station comprises means for shutting the mouth of the flexible containers.

32. A system as claimed in claim 31, wherein the second operating station is provided with means for sealing the mouth of the flexible container by thermowelding.

33. A system as claimed in claim 25, wherein a third station comprises means for sealing the mouth of the flexible container by thermowelding.

* * * * *